US006712618B2

(12) United States Patent
Welch

(10) Patent No.: US 6,712,618 B2
(45) Date of Patent: Mar. 30, 2004

(54) ELECTRICAL BRUSHLESS ROTARY CONNECTOR ASSEMBLY

(76) Inventor: LeRoy Welch, 6467 Balboa St., Rockford, IL (US) 61109

( * ) Notice: Subject to any disclaimer, the term of this patent is extended or adjusted under 35 U.S.C. 154(b) by 0 days.

(21) Appl. No.: 10/340,100

(22) Filed: Jan. 10, 2003

(65) Prior Publication Data

US 2003/0129857 A1 Jul. 10, 2003

Related U.S. Application Data

(60) Provisional application No. 60/346,855, filed on Jan. 10, 2002.

(51) Int. Cl.[7] ..... H01R 39/00
(52) U.S. Cl. ..... 439/13
(58) Field of Search ..... 439/13, 7, 930, 439/178, 179, 390, 5, 15, 164, 17–29; 279/128; 269/8

(56) References Cited

U.S. PATENT DOCUMENTS 5,342,067 A * 8/1994 Adler et al. ..... 279/158
6,299,453 B2 * 10/2001 Matsumoto ..... 439/15
2001/0007799 A1 7/2001 Matsumoto

* cited by examiner

*Primary Examiner*—Renee Luebke
*Assistant Examiner*—Felix O. Figueroa
(74) *Attorney, Agent, or Firm*—Leydig, Voit & Mayer, LTD

(57) ABSTRACT

A rotary connector assembly for an electrical apparatus on a rotating component is presented. The rotary connector assembly has a fixed base for mounting the assembly within the rotating component. The rotary connector assembly is rotatable relative to the rotating component. The attachment has an annular flange at the outer periphery and a mechanism that contacts the flange and supports the rotary connector portion. Connections at the base have terminations to attach incoming wiring and at the rotary portion to attach wiring to the electrical apparatus.

20 Claims, 5 Drawing Sheets

ELECTRICAL BRUSHLESS ROTARY CONNECTOR ASSEMBLY

CROSS-REFERENCE TO RELATED PATENT APPLICATIONS

This patent application claims the benefit of U.S. Provisional Patent Application No. 60/346,855, filed Jan. 10, 2002.

FIELD OF THE INVENTION

This invention pertains to electrical connections, and more particularly relates to electrical rotary connectors.

BACKGROUND OF THE INVENTION

Slip rings are used in a variety of applications to transfer electrical signals, including power signals, between components where one component rotates in relation to another component. One application where slip rings are used is in magnetic chucks to transfer power from the stationary frame of the magnetic chuck to the magnetic chuck rotating assembly. The slip ring is typically composed of a metal ring upon which a graphite material brush (and the like) rubs and transfers the signal. The metal ring or the graphite material brush rotates. FIG. 6 illustrates a typically slip ring assembly 10. The brush 12 is placed in a sleeve of a brush holder 14. The brush 10 is in electrical contact with brush connection 16 and a wire assembly 18 is connected to the brush connection 16. During operation, the brush contacts a conductive metal ring 20. A connection point 22 is attached to the ring 20 and wire leads 24 are connected to the connection point. As the ring 20 or brush 12 rotates, the brush 12 rubs against the ring 20 and signals are transferred across the brush/ring interface 26. The ring 20 and/or the brush 12 is connected to a rotating member of a device (not shown).

The operation of the slip ring is technically simple. However, there are a number of problems with slip rings in magnetic chuck applications. The brush wears down over time, which leads to degradation in the efficiency of transferring power and degradation of signal quality. Additionally, the brush and metal ring typically have high resistance, which results in power loss due to $I^2R$ heating losses. The resistance varies due to oxidation and other factors, which increases power losses and the fluctuations causes electrical noise. Additionally, the slip rings may need high levels of maintenance to remove the debris causes by the wear of the brushes and to replace the brushes. Other problems include electrical arcs that are produced as the slip ring assembly rotates. The arc, in combination with other factors, can lead to demagnetization problems with the magnetic chuck.

BRIEF SUMMARY OF THE INVENTION

The invention provides brushless rotary connector for use in magnetic chuck applications and the like. The rotary connector uses a housing having a sealed metal fluid with sliding contacts capable of handling high current levels. During rotation, the fluid maintains the electrical connection between the contacts without any wear, and the use of the liquid metal as a conduction path offers an extremely low resistance connection that is constant.

The housing is mounted in a base that serves as a support for the housing and for connections to the stationary component. The rotating member of the rotary connector is connected to a ring that is attached to the rotating member of the magnetic chuck. This connector is a simple, low cost and highly reliable connector. These and other advantages of the invention, as well as additional inventive features, will be apparent from the description of the invention provided herein.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 6:
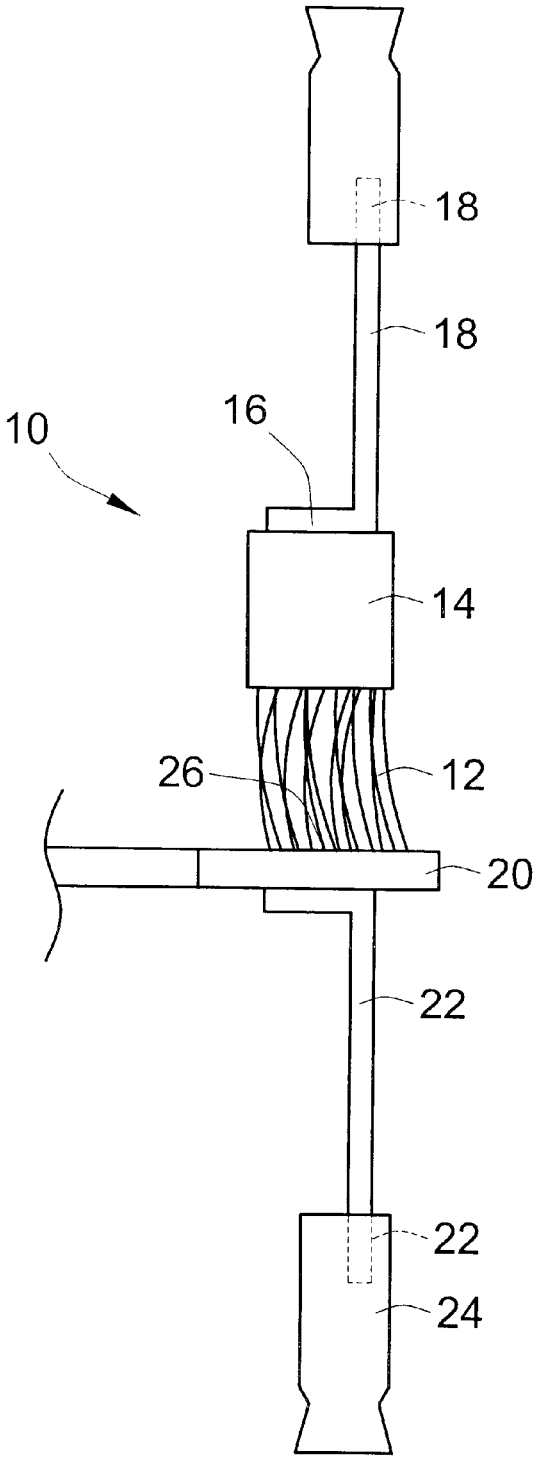
FIG. 6 (PRIOR ART)
FIG. 6 is a view illustrating a simplified slip ring assembly.
Figure 1:
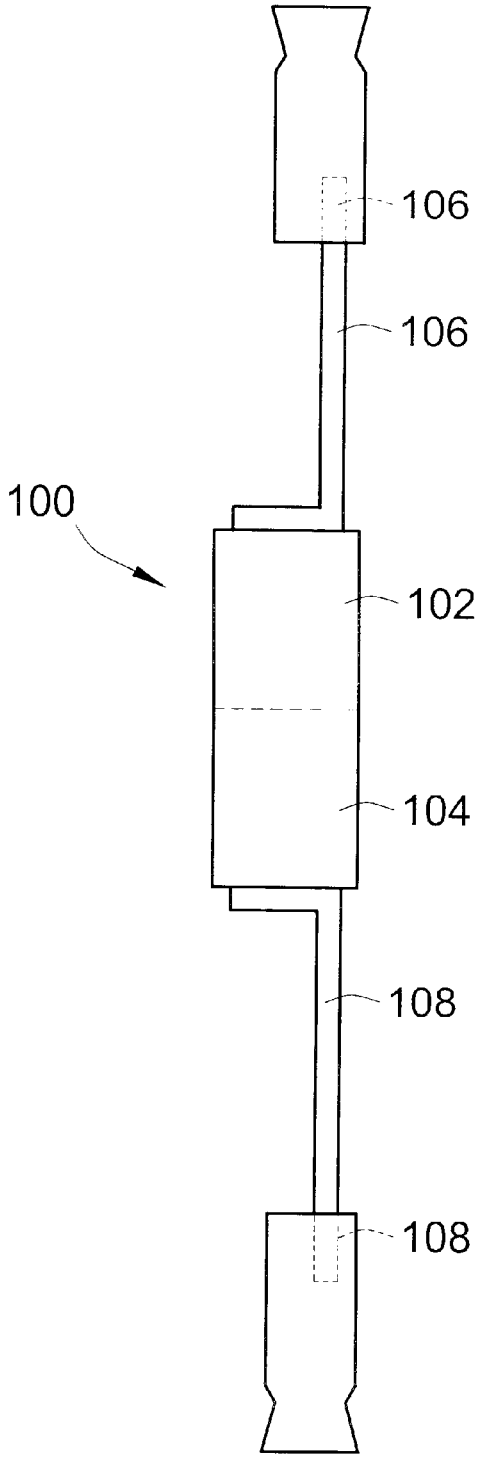
FIG. 1 is a block level diagram illustrating the rotary connector of the present invention.
Figure 2:
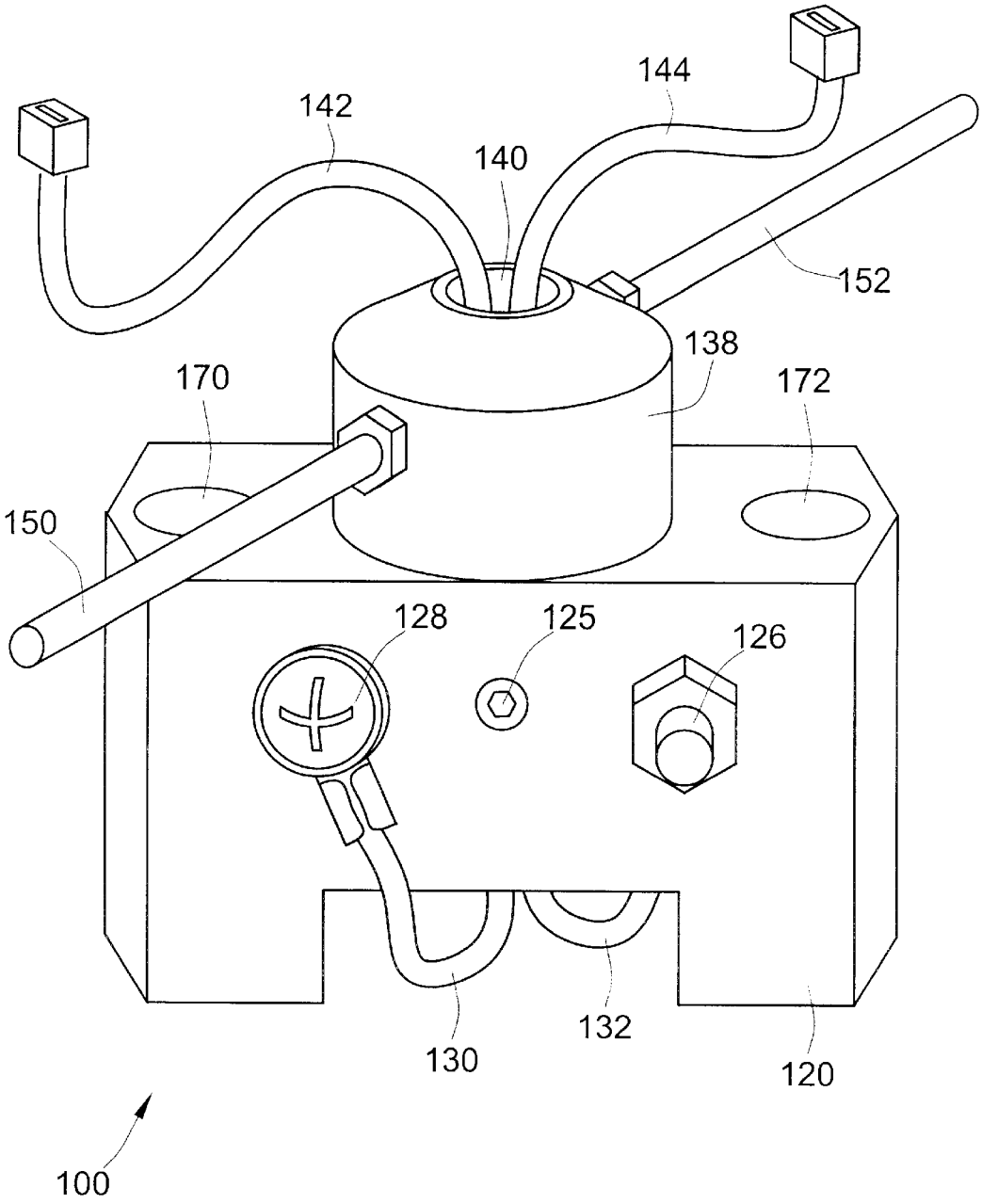
FIG. 2 is an isometric view of the rotary connector of the present invention with the yoke removed.
Figure 3:
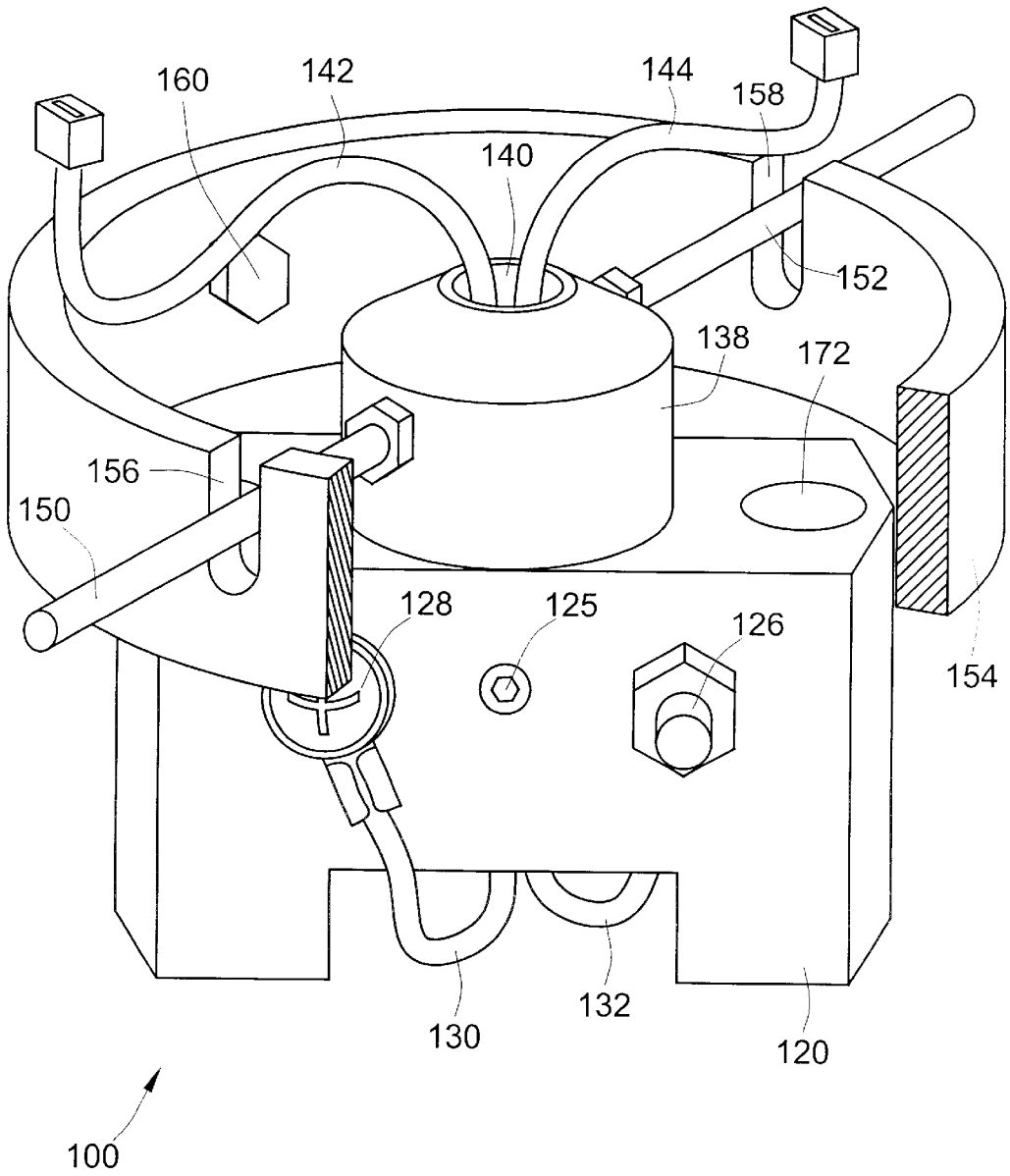
FIG. 3 is an isometric view of the rotary connector of the present invention inserted onto the yoke.
Figure 4:
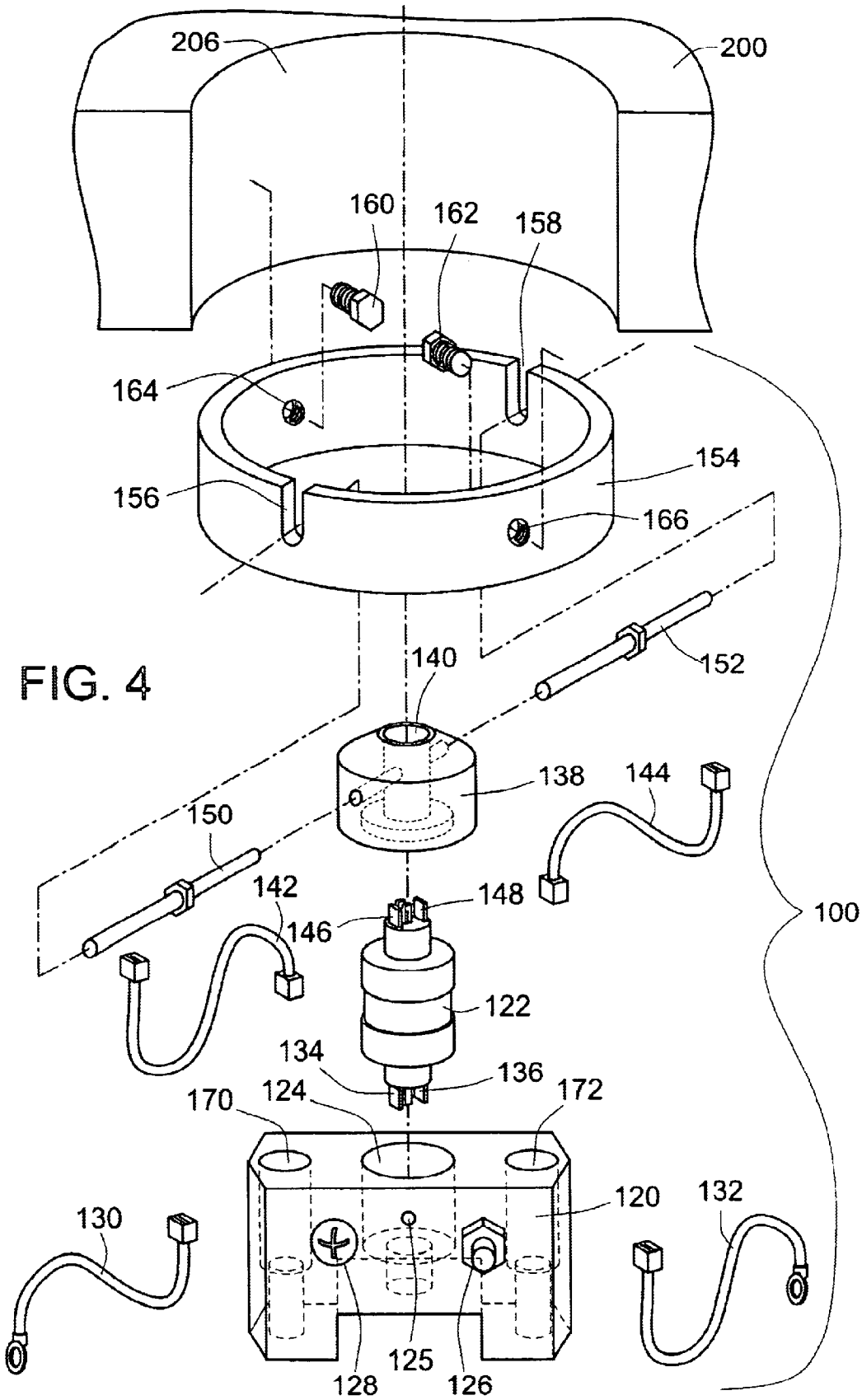
FIG. 4 is an exploded isometric view of the rotary connector of the present invention.
Figure 5:
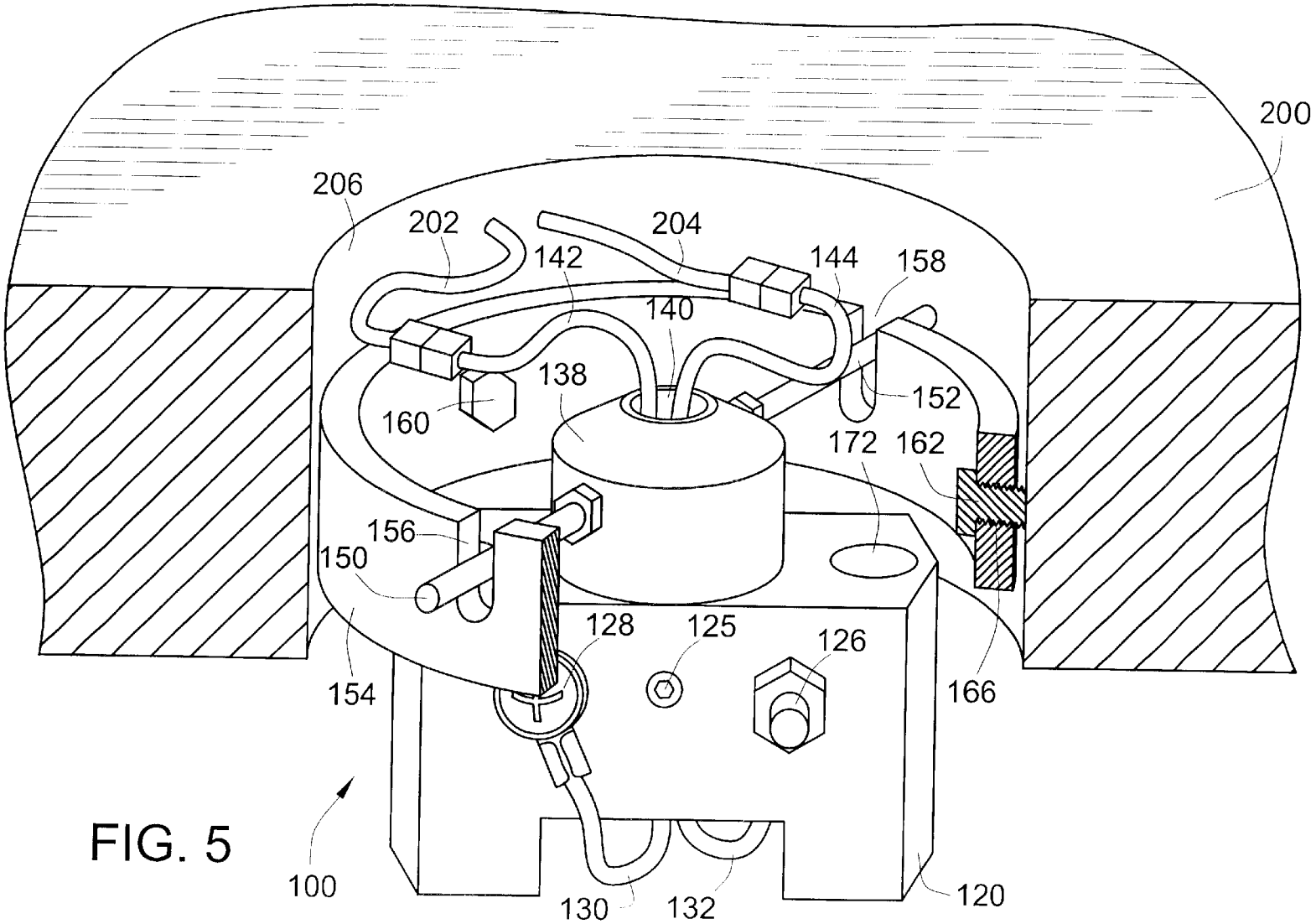
FIG. 5 is an isometric view of the rotary connector of the present invention installed in a rotary table housing.

Turning to the drawings, wherein like reference numerals refer to like elements, the invention will be described in an environment of a magnetic chuck such as those used in grinding operations. The rotary connector eliminates the "wear and replace" cycle of slip rings. FIG. 1 is a simplified schematic illustrating the elimination of brushes. The rotary connector 100 provides a connection through a conductive liquid film between contacts that rotate with respect to each other. One contact is in the top portion 102 of the rotary connector 100 and the other contact is in the bottom portion 104 of the rotary connector. Connection points 106, 108 provide one or more connections to wires, bus bars, etc.

Turning now to FIGS. 2–5, the rotary connector of the present invention is a brushless design incorporating sealed liquid contacts capable of handling high current levels in a superior manner to the traditional brush and slip ring method. The base 120 is a fixed or stationary support for the rotary connector main body 122 located in the center cavity 124 that is concentric to the rotary table housing 200 and associated electrical apparatus. The base is made of a hard plastic in one embodiment. The rotary connector main body 122 may be press fit or held in place via a set screw 125. The electrical apparatus in this case are conductors 202, 204 comprised to make a magnetic chuck. The base 120 also supports wire terminals 126, 128 for a power source (not shown) to provide power to the rotary connector 100. Wires or bus work 130, 132 connect the wire terminals 126, 128 to connection points 134, 136 of the rotary connector main body 122. The connection points 134, 136 are connected to the contact within the bottom portion of the rotary connector main body 122.

A rotating base 138 fits over the rotating portion of the rotary connector main body 122. The rotating base 138 has a hole 140 in which the rotating portion of the rotary connector main body 122 fits within. Wires 142, 144 are used to connect the electrical apparatus (e.g., conductors 202, 204) to the connections 146, 148 on the rotation portion of the rotary connector main body 122. Bus bars may also be used. The connection points 146, 148 are connected to the contact within the top portion of the rotary connector main body 122. Any type of wire connection may be used. For example, wire crimp lugs, self-contained splices, twist-locks, etc. The rotating base 138 supports legs 150, 152, which are used to provide support and orient the rotating base 138 with respect to a yolk 154 (e.g., annular flange). While FIGS. 2–5 illustrate the rotating base 138 covering the connections 146, 148, those skilled in the art will recognize that the rotating base 138 may be smaller than the height of the rotating portion of the rotary connector main body 122. This provides easy access to the connections 146, 148.

The yolk 154 attaches to the collector ring or table housing of the rotating component such as the magnetic chuck. The set of legs 150, 152 are attached to the rotating base 138 and extend out into access holes 156, 158 to engage the yolk 154. It should be recognized that a plurality of sets of legs may be used. The rotating base 138 is made of plastic or other types of soft or hard material that provide support for the legs 150, 152 and wire/bus bars 142, 144. The legs 150, 152 may be bar stock, hard plastic, bolts, etc. The yolk 154 may be plastic, fiberglass, a mold, etc. The yolk 154 is connected and enable the connector to table rotation. Set screws 160, 162 are used to secure the yolk 154 to the collector ring 206 (e.g., housing of the rotating component) of the rotating component 200 via threaded holes 164, 166 in the yolk 154. Bolts (now shown) are used to connect the base 120 to a fixed support in the stationary component (e.g., fixed table support of a magnetic chuck). The bolts are placed within bored holes 170, 172 to mount the base 120 to the fixed support. The bored holes 170, 172 have a seat for bolt head.

During operation, as the rotating component moves, the yolk 154 moves. The set of legs 150, 152 rotate as a result of the yolk 154 rotating. As a result, the rotating portion of the rotary connector main body 122 moves, thereby moving one of the contacts within the rotary connector main body 122. The conductive liquid film between the contacts in the rotary connector main body 122 maintains electrical connection as the contacts rotate with respect to each other.

In a preferred embodiment, the rotary connector 122 is manufactured by Mercotac, Inc. of Carlsbad, Calif. The connection in the Mercotac connector is made through a pool of liquid metal molecularly bonded to the contacts, and it provides a low resistance, stable connection. When there is rotation the fluid maintains the electrical connection between the contacts during rotation of either the upper portion or lower portion of the connector.

It can be seen that the rotary connector assembly of the present invention provides an economical way to provide power and/or electrical signals to a rotating component without having to use brushes. This eliminates the wear and replace cycle of brushes. The use of the legs and annular flange allows the rotary connector assembly to be used in rotating elements that has opening significantly larger than the size of the rotary connector. All that is needed to go from one size opening to another size opening with the same power rating and/or signal rating is to use a longer leg and larger annular flange. The further reduce cost, the legs may come in a standard size and cut to fit the application. The use of the legs also allows the base to be offset (i.e., non-concentric) from the center of the opening of the rotating component by adjusting the length of individual legs. This allows the rotary connector assembly to be used in situations where the mounting surface for the base is offset from the center of the opening of the rotating element.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A rotary connector assembly for transferring a signal between a stationary portion of an element and a rotating portion of the element, the rotary connector assembly comprising:

a rotating connector having a top portion and a bottom portion, the top portion and the bottom portion having a plurality of contacts;

a base for supporting the rotating connector, the base having mounting means to mount the base to a stationary element and a wire terminal;

means for connecting the plurality of contacts of the bottom portion to the wire terminal;

a rotating base connected to the top portion of the rotating connector; and at least one set of legs attached to the rotating base, the at least one set of legs attached to an annular flange, the annular flange attached to the rotating portion.

2. The rotary connector assembly of claim 1 wherein the rotating portion of the element has at least one connection, the rotary connector assembly further comprising second means for connecting the plurality of contacts on the top portion to the at least one connection point.

3. The rotary connector assembly of claim 2 wherein the second means for connecting the plurality of contacts comprises at least one wire.

4. The rotary connector assembly of claim 2 wherein the second means for connecting the plurality of contacts comprises at least one bus.

5. The rotary connector assembly of claim 1 wherein the means for connecting the plurality of contacts comprises one of a bus and a wire.

6. The rotary connector assembly of claim 1 wherein the base has a central cavity and the rotating connector is placed in the central cavity.

7. The rotary connector assembly of claim 6 wherein the rotating connector is press fit into the central cavity.

8. The rotary connector assembly of claim 6 wherein the rotating connector is held in place with a set screw.

9. The rotary connector assembly of claim 1 wherein the at least one set of legs comprises bar stock.

10. The rotary connector assembly of claim 1 wherein the at least one set of legs comprises plastic.

11. The rotary connector assembly of claim 1 wherein the annular flange is plastic.

12. The rotary connector assembly of claim 1 wherein at least one of the annular flange, the rotating base, and the base are made from a mold.

13. The rotary connector assembly of claim 1 wherein the mounting means comprises at least one bored hole having a seat.

14. A rotary connector assembly for transferring a signal between a stationary element and a rotating element, the rotary connector assembly comprising:

a rotating connector having a top portion and a bottom portion, the top portion and the bottom portion having a set of contacts;

a base for supporting the rotating connector, the base mountable to the stationary element and having a plurality of wire terminals, the set of contacts of the bottom portion connected to the plurality of wire terminals;

a rotating base connected to the top portion of the rotating connector;

a set of legs attached to the rotating base; and an annular flange attached to the rotating element and the set of legs.

15. The rotary connector assembly of claim 14 wherein the annular flange has a set of access holes and the set of legs is placed within the set of access holes.

16. The rotary connector assembly of claim 14 wherein annular flange has a plurality of threaded holes for receiving set screws and the annular flange is attached to the rotating flange with set screws.

17. The rotary connector assembly of claim 14 wherein the set of contacts of the bottom portion is connected to the plurality of wire terminals with one of a plurality of wires and a plurality of busses.

18. The rotary connector assembly of claim 14 wherein one leg of the set of legs is shorter than the other leg of the set of legs.

19. The rotary connector assembly of claim 14 wherein the base has at least one bored hole having a seat.

20. The rotary connector assembly of claim 14 wherein the base has a cavity for supporting the rotating connector, the rotating connector held in place with one of a press fit and a set screw.

* * * * *